US012583556B2

(12) United States Patent
Steed et al.

(10) Patent No.: US 12,583,556 B2
(45) Date of Patent: Mar. 24, 2026

(54) SELF-DRAINING SCUPPER

(71) Applicant: Lifetime Products, Inc., Clearfield, UT (US)

(72) Inventors: Brent R. Steed, Syracuse, UT (US); Samuel S. Robbins, South Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 431 days.

(21) Appl. No.: 18/180,022

(22) Filed: Mar. 7, 2023

(65) Prior Publication Data

US 2024/0158050 A1 May 16, 2024

Related U.S. Application Data

(60) Provisional application No. 63/318,098, filed on Mar. 9, 2022.

(51) Int. Cl.
*B63B 13/00* (2006.01)
*B63B 13/02* (2006.01)

(52) U.S. Cl.
CPC ..... *B63B 13/00* (2013.01); *B63B 13/02* (2013.01)

(58) Field of Classification Search
CPC ..... B63B 13/00; B63B 13/02; B63B 1/00; B63B 1/18; B63B 1/38
USPC ..... 114/182
See application file for complete search history.

(56) References Cited

U.S. PATENT DOCUMENTS

| | | | | |
|---|---|---|---|---|
| 6,615,760 | B1 | 9/2003 | Wise et al. | |
| 8,136,466 | B2 * | 3/2012 | Farber | B63B 13/00 114/183 R |
| 8,763,548 | B2 * | 7/2014 | Swetish | B63B 13/00 114/182 |
| 10,676,163 | B2 * | 6/2020 | Robbins | B63B 34/21 |
| 2010/0263745 | A1 | 10/2010 | Symes | |
| 2011/0041750 | A1 | 2/2011 | Farber | |
| 2012/0137948 | A1 | 6/2012 | Swetish et al. | |
| 2018/0057124 | A1 | 3/2018 | Robbins et al. | |
| 2021/0285560 | A1 | 9/2021 | Michaeli et al. | |

FOREIGN PATENT DOCUMENTS

KR 20-2018-0002051 U 7/2018

OTHER PUBLICATIONS

International Search Report and Written Opinion received for PCT Patent Application No. PCT/US2023/063917, mailed on Jul. 11, 2023, 10 pages.

* cited by examiner

*Primary Examiner* — Lars A Olson
(74) *Attorney, Agent, or Firm* — Workman Nydegger

(57) ABSTRACT

In one example, a watercraft includes a hull that defines a recessed portion, and the hull is a unified, single-piece, structure. The watercraft further includes a self-draining scupper with a passageway that is integral with the hull and communicates with the recessed portion, the passageway extending from the recessed portion through an exterior surface of the hull. The self-draining scupper further includes a stopper disposed in the passageway, and a flow plate that helps to confine the stopper in the passageway.

20 Claims, 3 Drawing Sheets

SELF-DRAINING SCUPPER

FIELD OF THE INVENTION

One or more embodiments of the invention generally relate to watercraft, examples of which include, but are not limited to, kayaks, canoes, row boats, rowing shells, paddle-boats, and any other human-powered watercraft, suitable for use in water sports or other activities. At least one example embodiment embraces a watercraft that includes a scupper which is self-draining.

BACKGROUND

Some conventional approaches to implementing scupper drain functionality involve the use of a scupper insert that must be installed, and secured, in a specially configured opening in the hull of the watercraft. However, this approach is problematic, at least because the scupper insert may have to be properly oriented and positioned in the hull in order to function properly. Moreover, a scupper insert typically requires maintenance, and may have a number of different parts, such as O-rings for example, that eventually deteriorate, resulting in leakage. Deterioration of components may be a particular concern where the watercraft is employed in saltwater environments. As a result, the O-rings, and other parts, of a scupper insert may have to be periodically replaced. Further, metal parts of a scupper insert may be vulnerable to rust and corrosion, which may impair or defeat their functionality. Thus, conventional scupper inserts may be associated with a maintenance burden, as well as the time and costs needed to replace parts, or the entire scupper insert itself.

Moreover, conventional scupper inserts, which may also be referred to as 'scupper plugs,' require a relatively large hole in the deck in order that the outside diameter of the scupper plug can be accommodated. Due to the size and configuration of the scupper insert however, only a small portion of that hole is available for drainage purposes. Particularly, the inside diameter of the fluid passageway of the scupper insert itself is quite small relative to the diameter of the hole in the deck and, as a result, conventional scupper inserts drain much more slowly than would be the case if the scupper plug were absent and water was free to drain from the hole in the deck. Slow drainage may, at least, reduce the comfort of the passengers in the watercraft, and may be particularly concerning when a significant amount of water is entering the watercraft, such as may occur in rough and/or rainy conditions for example.

Aspects of Some Example Embodiments

An embodiment of the invention is concerned with a watercraft that may comprise one or more self-draining scuppers. The watercraft may be human-powered, such as a kayak for example, but that is not necessarily required, and example embodiments may be employed in motorized watercraft that include a hull, which may comprise fiberglass, plastic, composites, and/or other material, which defines a passageway that may, or may not, be integral with the hull.

An example self-draining scupper, which may be referred to herein simply as a 'scupper,' may be positioned at various locations in the cockpit of a watercraft. Because the scupper may be located at a relatively low point in the cockpit, water entering the cockpit may run to, and be collected by, the scupper. In this way, the scupper may help to keep water from pooling in the bottom of the watercraft.

In an embodiment, a self-draining scupper may include a passageway that extends from a bottom of a hull of a watercraft up to a cockpit, and/or other portion, of the watercraft. The passageway may be integrally formed with the hull of the watercraft, such as by a blow-molding process, or other molding process, for example. Thus, in an embodiment, the passageway may be formed at the same time as the hull, and the hull and the passageway may be integral elements of a unitary, single-piece, structure. The passageway may define an integral seat that is configured and arranged for sealing engagement with a stopper that is able to move freely within the passageway.

In an embodiment, a flow plate may be provided that is configured and positioned to cooperate with the seat to confine the stopper in the passageway, although the stopper may be movable within the passageway. In particular, the flow plate, in cooperation with the seat, may serve to define a range of motion of the stopper in the passageway. The flow plate may include an opening that may allow water and/or other fluid(s) in the cockpit to exit the watercraft by way of the passageway when the stopper is not in sealing contact with the seat.

The flow plate, stopper, and seat, may cooperate to enable water to exit the cockpit by way of the passageway. As well, the flow plate, stopper, and seat, may cooperate to prevent water from entering the cockpit through the bottom of the hull. Thus, the stopper may act as a check valve, permitting fluid flow in one direction, but preventing fluid flow in the opposite direction.

As will be apparent from this disclosure, example embodiments of the invention may be advantageous in various respects. For example, an embodiment may reduce, or eliminate, the need for the installation, maintenance, and/or, replacement, typically associated with conventional discrete scupper assemblies that are installed in watercraft after the manufacture of the watercraft hull. An embodiment may employ a relatively small number of parts and thus present minimal manufacturing complexity. An embodiment may be relatively light in weight as compared with conventional marine drain valves. An embodiment may require little, or no, maintenance. An embodiment may comprise low-cost parts. An embodiment may comprise, or consist of, non-metallic parts that are impervious to rust and corrosion. Components of an embodiment may be built into a watercraft hull at the same time the watercraft hull is created, such that, for example, a portion of the embodiment is integral with, and integrally formed with, the watercraft hull. An embodiment may provide a passageway that is relatively large, as compared with conventional approaches, so as to enable more rapid draining of water from the watercraft. Various other advantages of example embodiments will be apparent from this disclosure.

It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of various example embodiments to further illustrate and clarify the above and other aspects of example embodiments of the invention. It will be appreciated that these drawings depict only example embodiments of the invention and are not intended to limit its scope. Example embodiments of the invention will be described and explained with additional specificity and detail through the use of the accompanying drawings.

DETAILED DESCRIPTION OF SOME EXAMPLE EMBODIMENTS

Figure 1:
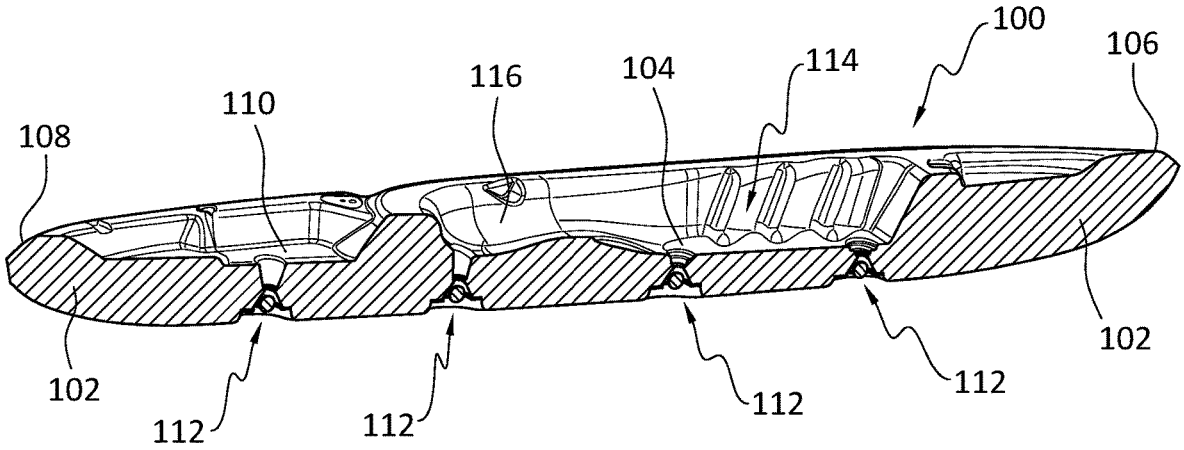
FIG. 1 discloses a section view of a watercraft hull including one or more scuppers, according to an embodiment.

With reference now to the figures, details are provided concerning aspects of example embodiments of the invention. Such embodiments may comprise, or be employed with, a variety of different watercraft, examples of which include, but are not limited to, kayaks such as sit-inside kayaks and sit-on-top kayaks, canoes, row boats, rowing shells, paddleboats, and any other human-powered watercraft, suitable for use in water sports or other activities. Embodiments of the invention may further comprise, or be employed with, motorized watercraft. Thus, the scope of the invention is not limited to any particular type of watercraft.

A. General Aspects of Some Example Embodiments

In general, the example watercraft and components disclosed herein may be constructed, in whole or in part, with a variety of elements and materials including, but not limited to, plastic (including blow molded plastic structures and elements) such as high density polyethylene (HDPE), including polycarbonates, composites, fiberglass, metals, and combinations of any of the foregoing.

Depending upon the material(s) employed in the construction of one or more embodiments, a variety of methods and components may be used to connect, releasably or permanently, various elements of one or more embodiments. For example, the various elements of components within the scope of this disclosure may be attached to each other by any one or more of allied processes such as welding or brazing, soldering, and/or mechanically by way of fasteners such as bolts, screws, pins, and rivets, for example.

Where a first plastic component, such as the disclosed flow plate for example, is mechanically connected to a second plastic component, such as a watercraft, the first plastic component may be snap-fit into a recess or other feature defined by the second plastic component. More generally, in an embodiment, the first and second plastic components may comprise respective complementary structures configured and arranged to releasably, or permanently, engage each other. Thus, for example, a flow plate may be snap-fit into a recess or other complementary structure defined by a watercraft. Further, a flow plate may be removed from the watercraft by elastically deforming the flow plate until the flow plate has disengaged from the complementary structure defined by the watercraft. Thus, for example, the complementary structures of the flow plate and the watercraft may enable a flow plate, and stopper, to be easily removed and replaced, if necessary.

Some, none, or all of the, portions of a one or more of the disclosed components may be coated or otherwise covered with paint, rubber, plastic or other materials, or any combination of the foregoing. Surface treatments and textures may also be applied to, or integral with, elements, such as decks or footrests for example, of the disclosed embodiments. At least some of such materials and/or surface treatments/textures may serve to help prevent, or reduce, rust and corrosion, and/or such surface treatments/textures may improve grip and prevent slipping by a human operator. Various other materials that may be employed in one or more components and elements are disclosed elsewhere herein.

Where plastic, such as HDPE for example, is employed in the construction of a watercraft, the watercraft may take the form of an integral blow-molded plastic structure of a unified, single-piece construction. The interior of the watercraft may be hollow in such embodiments. In other embodiments, a watercraft may be constructed using processes such as injection molding, stretch blow molding, rotomolding, or twin sheet molding, for example. No particular production process is required for any embodiment however.

Finally, any embodiment of a kayak or other watercraft that includes a hull which is constructed at least partly of blow-molded, or otherwise formed, plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other and depressions that are spaced apart from each other may both be present in a kayak or other watercraft. The depressions may be sized and configured to strengthen and/or reinforce the blow-molded plastic hull of the kayak or other watercraft. Finally, the depression, or depressions, can be any shape or size, and depressions of different respective shapes and/or sizes can be combined in a single watercraft.

B. Aspects of an Example Watercraft

B.1 Watercraft Configuration

With reference now to FIG. 1, details are provided concerning various aspects of example embodiments of the invention. As shown in the example of FIG. 1, an embodiment of the invention may comprise a watercraft 100 such as, for example, a sit-inside kayak or sit-on-top kayak. Embodiments may extend to other types of watercraft, examples of which are disclosed elsewhere herein. The example watercraft 100 includes a hull 102. The hull 102 may be an integral plastic blow-molded structure having a unified, single-piece construction. The hull 102 may be hollow. In other embodiments, the hull 102 may be constructed using processes such as injection molding, stretch blow molding, rotomolding, or twin sheet molding. The example watercraft 100 may comprise a variety of different components.

The hull 102 may define a cockpit 104, as well as a bow 106 and stern 108 of the watercraft. In an embodiment, the hull 102 may define a recessed portion 110 that may serve as a storage area, and one or more scuppers 112, each of which may comprise a self-draining scupper for example, may be configured and arranged to drain the recessed portion 110 and the cockpit 104. The number of scuppers 112 employed in an embodiment may be a function of the volume of the space(s) to be drained, and the amount of water expected to enter those spaces. As also indicated in FIG. 1, one or more foot rests 114 may be defined on either side of the cockpit 104, and a seat 116 provided in the cockpit. In an embodiment, a scupper 112 may provided in the seat 116 area to prevent water from accumulating in the seat 116.

B.2 Example Self-Draining Scupper Configuration and Arrangement

Figure 2:
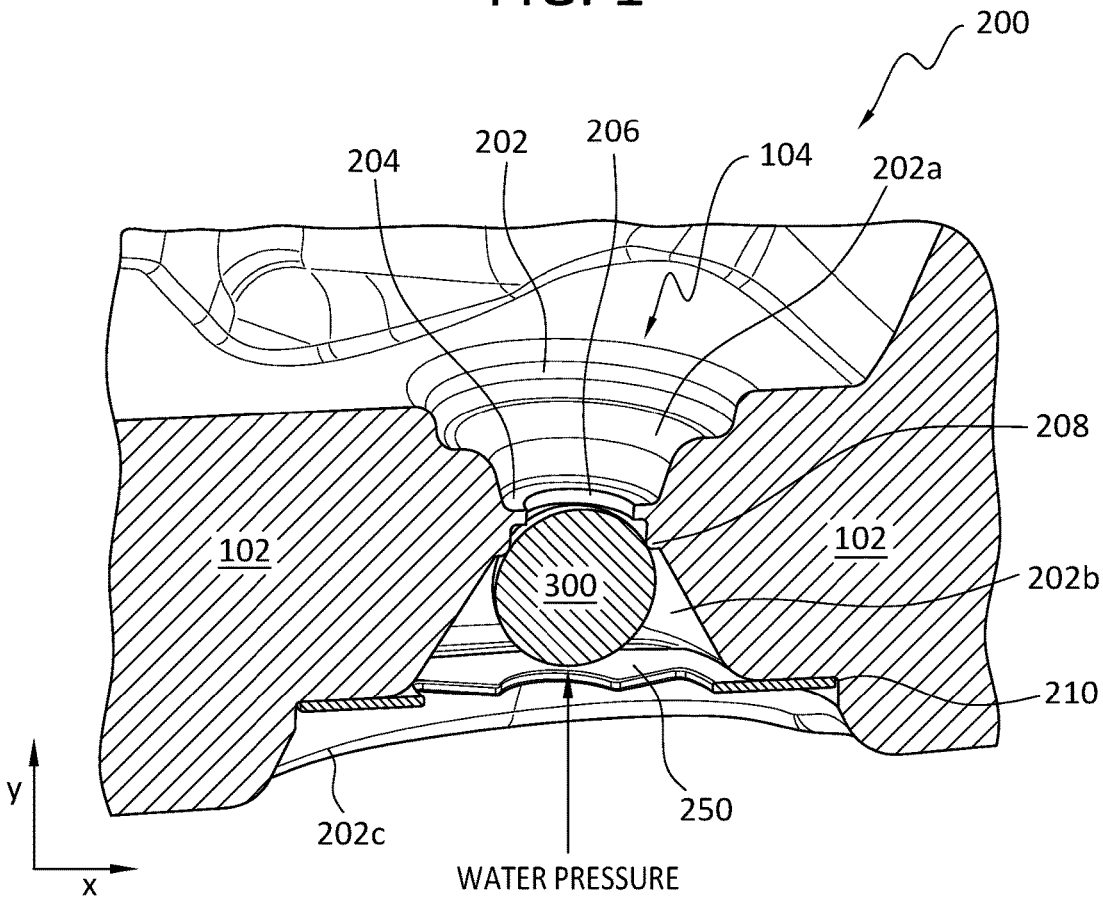
FIG. 2 is a detail section view of a scupper, according to one embodiment.
Figure 4A:
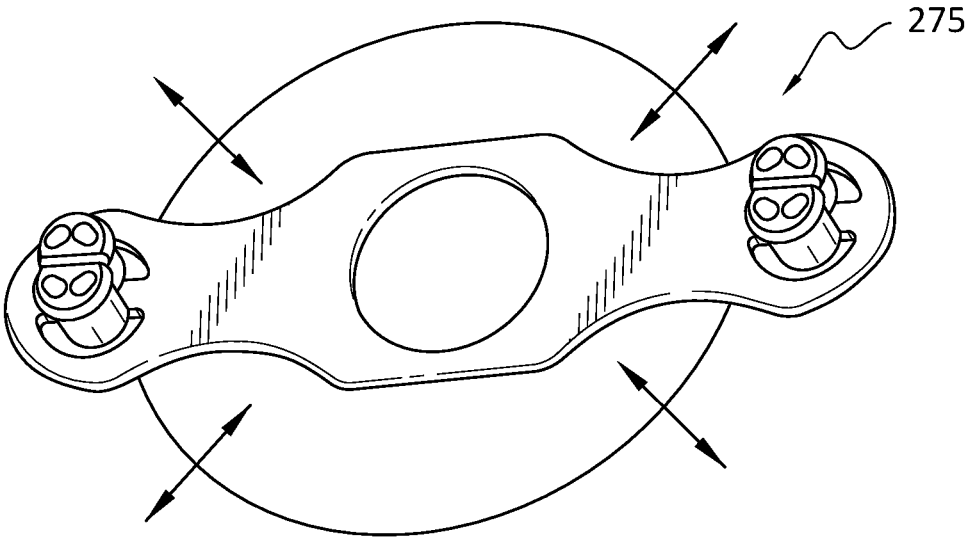
FIG. 4*a* discloses an alternative embodiment of a flow plate.
Figure 3:
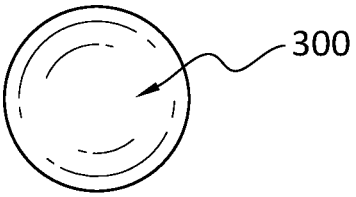
FIG. 3 discloses an example stopper, according to one embodiment.
Figure 4:
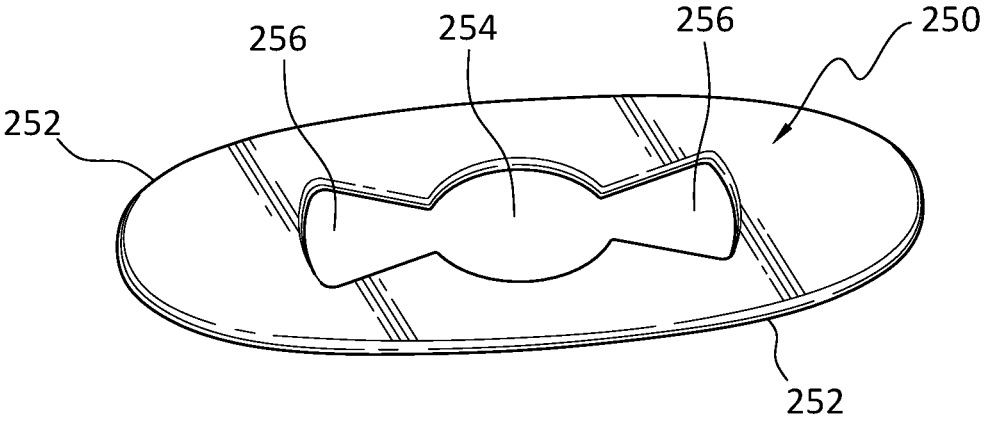
FIG. 4 discloses an example flow plate, according to one embodiment.
Figure 5A:
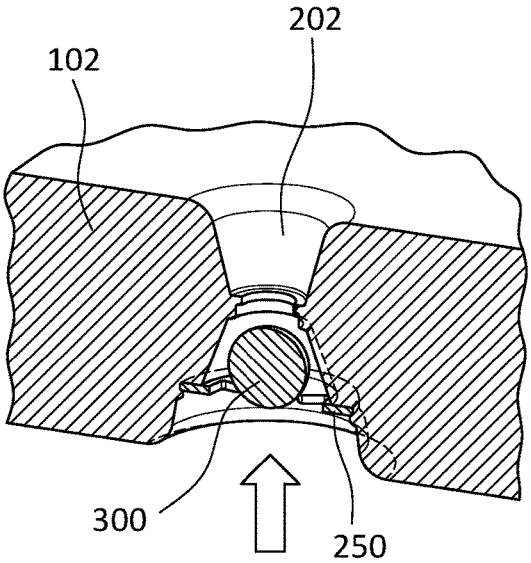
FIGS. 5*a* and 5*b* disclose fluid flow paths in a scupper, according to one embodiment.
Figure 5B:
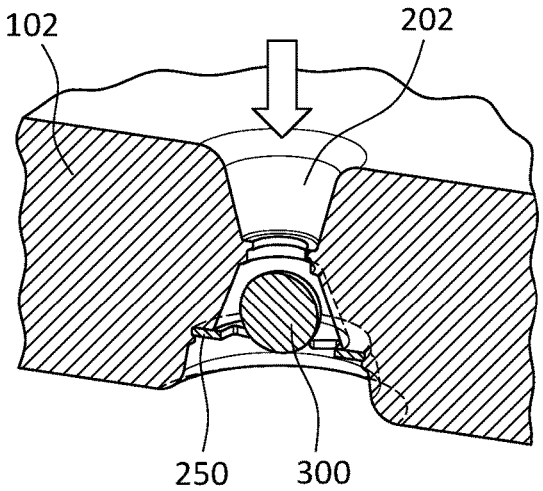

With particular reference now to FIGS. 2-5*a* and 5*b*, example embodiments of a self-draining scupper are disclosed, where one such example is denoted at 200. In general, and with reference to FIG. 2, an embodiment of a self-draining scupper 200 may comprise a passageway 202. The passageway 202 may be integral with, and defined by, the hull and/or other portions of watercraft 100. Thus, in an embodiment, the passageway 202 may be formed at the same time as the hull 102 during a manufacturing process, such as a blow-molding, or other molding, process for example. As shown in FIGS. 2 and 5*a* and 5*b* the passageway 202 may extend from a location inside the watercraft 100, such as the cockpit 104 for example, and through the hull 102, such that any fluid, such as water for example, inside the cockpit 104 is able to exit the cockpit 104, and/or other interior portions of the watercraft 100, by way of the passageway 202. The passageway 202 may be any desired size both in terms of its length, and diameter(s). The diameter of the passageway 202 may, for example, be a function of the volume served, that is, to be drained, by the scupper 200, and/or the amount of fluid expected to enter that volume due to rough conditions, rain, and/or other considerations.

In an embodiment, and as shown in FIG. 2, the passageway 202 may comprise an inlet 202*a* located in a floor, or other low point, of the cockpit 104, a middle portion 202*b* in communication with the inlet 202*a*, and an outlet 202*c* in communication with the middle portion 202*b*. The inlet 202*a*, middle portion 202*b*, and outlet 202*c*, may be circular in shape, but that is not required, and other shapes, such as elliptical configurations for example, may be employed in some embodiments. In the example passageway 202, the inlet 202*a* may be relatively large in diameter so as to provide a relatively large fluid collection volume that may facilitate relatively more rapid draining of an interior portion of the watercraft. No particular size of inlet 202*a* is required however.

As shown, the inlet 202*a* may taper down in diameter to the middle portion 202*b* such that the inlet 202*a* has a larger inside diameter than the inside diameter of the middle portion 202*b*. The narrowest part, or smallest inside diameter portion, of the passageway 202 may be defined by an annular shoulder 204 that may be integral with the hull 102. Water or any other fluid exiting the inlet 202*a* may pass through an opening 206 defined by the annular shoulder 204. Due to the presence of the opening 206, and the configuration of the inlet 202*a*, a portion of a stopper 300, see FIGS. 2, 3, and 5*a* and 5*b*, positioned in the passageway 202 may be visible to, and accessible by, a user looking into the inlet 202*a*. For example, if the stopper 300 should become stuck for some reason, or foreign material becomes lodged in the inlet 202*a*, a user can insert a hand or finger, or object, into the opening 206 of the inlet 202*a* and dislodge the stopper 300 or foreign material. Note that the outside diameter of the stopper 300 may be greater than the inside diameter of the opening 206. The stopper 300 may, or may not, be able to contact the annular shoulder 204. In some embodiments, the annular shoulder 204 may be omitted. Further, the outlet 202*c* may be configured with a tapered portion that opens into another portion with a relatively large inside diameter, possibly larger than the inside diameter of any other portion of the passageway 202.

With continued reference to FIG. 2 in particular, the passageway 202 may further define an annular seat 208 positioned below the annular shoulder 204, and configured and arranged for sealing contact with the stopper 300. The annular seat 208 may be integral with the hull 102. The seat 208 need not have any particular configuration. In some embodiments, the seat 208 may define an annular contact surface, which may be inclined relative to a Y-axis (see FIG. 2), arranged for contact with the stopper 300. This configuration of the seat 208 may provide for an increased contact area between the stopper 300 and the seat 208, relative to what the contact area would be if the annular contact surface were not inclined, or less inclined, relative to the Y-axis. Finally, the seat 208 may be configured to contact the stopper 300, and to prevent the stopper 300 from contacting the shoulder 204. When the stopper 300 is pressed upward into sealing engagement against the seat 208, as shown in FIGS. 2 and 5*a* and 5*b* for example, such as by hydrostatic pressure exerted by water on the underside of the hull 102 when the hull 102 is in a body of water, the water may be prevented, by the cooperation of the stopper 300 and seat 208, from passing through the outlet 202*c* into the cockpit 104.

The seat 208 and shoulder 204 may each have a respective inside diameter sized to ensure a sufficiently high flowrate through the scupper 200 that water does not pool inside the watercraft. Thus, given a desired flowrate Q through the passageway 202, the minimum inside diameter D needed for the passageway 202 may be determined by $Q=vA$, where $v$=the velocity of the flow, which may be primarily, or exclusively, imparted by gravitational force, and $A$=the area ($\pi D^2/4$), where $D$=the minimum inside diameter through which the flow will pass. In the example of FIG. 2, the minimum inside diameter of the scupper 200 is defined by the opening 206.

Note that the passageway 202 may be sized and configured such that when the inlet 202*a* is sufficiently full of fluid, which may or may not be completely full, the hydrostatic pressure of that fluid in the inlet 202*a* may exceed the hydrostatic pressure exerted upward on the stopper 300 by the water in which the watercraft 100 is disposed. Thus, the hydrostatic pressure exerted by the fluid in the inlet 202*a* may operate to unseat the stopper 300 from the seat 208, and thereby enable fluid in the inlet 202*a* to pass through the middle portion 202*b*, and exit the watercraft 100 by way of the outlet 202*c*. Fluid may continue to flow out of the watercraft 100 in this way as long as this pressure differential exists. The magnitude of the pressure differential, if any, may be affected by movement of the watercraft in the water.

In some embodiments, the stopper 300 and/or the seat 208 may comprise a compliant material, such as rubber or foam rubber for example, so that either, or both, of the stopper 300 and the seat 208 may slightly elastically deform in response to the hydrostatic water pressure exerted on the stopper 300. This elastic deformation may contribute to, or cause, a sealing engagement of the stopper 300 against the seat 208 so as to prevent water from passing into the cockpit 104 by way of the outlet 202*c* of the passageway 202. The use of compliant material is not necessarily required however, and in some embodiments, the compliant material may be omitted and the seal between the stopper 300 and the seat 208 may be adequate to prevent any flow, or allow only nominal flow, through the outlet 202*c* into the cockpit 104.

With continued reference to FIG. 2, and directing attention to FIG. 4 as well, an embodiment of the self-draining scupper 200 may further comprise a flow plate 250 configured and arranged to cooperate with the seat 208 to confine the stopper 300 in the passageway 202. In one embodiment, the flow plate 250 may generally include a complementary structure 252, such as an edge of the flow plate 205 for example, that is configured and arranged to engage q corresponding complementary structure 210, such as a recess defined in the hull 102 near the outlet 202*c*. The flow plate 250 may be configured so that it may, or may not, permanently engage the hull 102. No particular configuration of the complementary structure 252 or complementary structure 210 is required in any embodiment. Thus, as exemplified in the Figures, an embodiment of a self-draining scupper may comprise, or consist of, three elements, namely, a passageway, a stopper, and a flow plate. In some embodiments, the flow plate 250, which may be made of plastic, rubber, and/or other flexible material(s), may be configured to snap-fit into a recess or shoulder defined in the hull 102 in or near the outlet 202*c*. In an embodiment, the flow plate 250 may be removed from the hull 102 by pulling the flow plate 250 downward away from the hull 102 so as to flex, or elastically deform, the flow plate 250 to the extent that a complementary structure of the flow plate 250 disengages from a complementary structure of the hull 102, thus releasing the flow plate 250 from the hull 102.

As best shown in FIG. 4, the flow plate 250 may, in an embodiment, define a central opening 254 that may be configured and arranged to enable water to flow in either direction through the passageway 202, such as from the outlet 202*c* or from the inlet 202*a*, as shown in the example of FIGS. 5*a* and 5*b*. Further, the flow plate 250 may be configured, when installed in the hull 102, to confine the stopper 300 in the passageway 202, while still allowing water to flow into, and out of, the passageway 202.

In particular, the central opening 254 of the flow plate 250 may be sized and configured to have an inside diameter smaller than the outside diameter of the stopper 300. Thus, when water is flowing out of the watercraft 100, the stopper 300 may contact the flow plate 250 but will be prevented from passing through the flow plate 250. Note that while, in this circumstance, the stopper 300 may partly, or completely, block the central opening 254, water is still able to flow through side openings 256, and thereby exit the passageway 202 by way of the outlet 202*c*. On the other hand, when water flows into the passageway 202 from outside of the watercraft, the water may flow through both the central opening 254 and the side openings 256, and press the stopper 300 against the seat 208, at which point flow through the central opening 254, from outside the hull 102, stops. Thus, the flow plate 250 is configured, in an embodiment, to permit water flow both out of, and into, the passageway 202.

Note that while the side openings 256, in the example of FIG. 4, communicate with the central opening 254 to collectively define a single opening in the flow plate 250, that is not required. In one alternative embodiment, one or more openings, such as the side openings 256 for example, may be provided in the flow plate 250 that are discrete from the central opening 254, such that the flow plate 250 defines multiple, separate, openings that are not connected to each other.

With attention now to FIG. 4*a*, an alternative embodiment of a flow plate is denoted at 275. In general, the flow plate 275 may operate in the same manner as the flow plate 250, although may be configured differently. The flow plate 275 defines a central opening 277 that functions in the same way as the central opening 254 of the flow plate 250. While the flow plate 250 is configured to enable water to flowthrough the side openings 256, the flow plate 277 is configured so that water is able to flow, as indicated by the arrows, through the area, or opening, 279 collectively defined by a portion of the perimeter 281 of the flow plate 277 and the scupper opening 283.

Thus, the stopper 300 (not shown in FIG. 4*a*) may partly, or completely, block the central opening 277, water is still able to flow through the area 279, and thereby exit the passageway (202 in FIG. 4) by way of the outlet (202*c* in FIG. 4). On the other hand, when water flows into the passageway (202 in FIG. 4) from outside of the watercraft, the water may flow through both the central opening 277 and the area 279, and press the stopper 300 (not shown in FIG. 4*a*) against the seat (208 in FIG. 4), at which point flow through the central opening 277, from outside the hull (102 in FIG. 4), stops. Thus, the flow plate 275 is configured, in an embodiment, to permit water flow both out of, and into, the passageway (202 in FIG. 4).

Finally, as shown in FIG. 4*a*, the flow plate 275 may comprise one or more attachment devices 285 comprising structures that extend outward and are configured to releasably engage corresponding recesses in the hull 202. In this way, the flow plate 275 may be attached to, and released from, the hull 202.

B.3 Example Stoppers

A stopper according to some embodiments, such as the example stopper 300 in FIGS. 2 and 3, may be generally spherical in shape, although any other stopper shape that would be effective in performing the functions disclosed herein may alternatively be employed. The stopper may be hollow or solid. The stopper may comprise a buoyant material, such as foam for example. The material from which the stopper is made may by of a type that does not readily absorb and retain water, such as hard plastic or closed-cell foam, for example. In some embodiments, the stopper may comprise a standard ping-pong ball. No particular material or configuration of a stopper is required in any embodiment.

B.4 Aspects of Self-Draining Scupper Operation

With continued reference to FIGS. 1-5, further details are provided concerning the operation of a self-draining scupper, such as the example self-draining scuppers disclosed herein. In general, and as noted elsewhere herein, an embodiment may include a passageway, defined by, and integral with, a structure such as the hull of a watercraft for example. The passageway may define a seat which may be engageable by a stopper that acts under the influence of water pressure in, and/or exterior to, the passageway, and that is confined in the passageway by a flow plate.

In an embodiment, the self-draining scupper may have two modes of operation, namely, a drain mode, and a stop mode. In the stop mode, shown in the illustration of FIG. 5*a*, water pressure exerted by the water in which the watercraft is floating acts upward on the stopper 300 so as to push the stopper 300 into contact with the seat (see FIG. 2) defined in the passageway 202. When the stopper 300 is seated on the seat in this way, water is prevented from entering the watercraft through the passageway 202. As long as the hydrostatic pressure of the water and/or other fluid, if any, in the passageway 202 above the stopper 300 is less than the hydrostatic pressure exerted on the stopper 300 by the water in which the watercraft is disposed, the stopper 300 will remain seated, preventing the flow of water from the exterior environment, through the hull 102 by way of the passageway 102, and into the watercraft.

The self-draining scupper may also operate in a drain mode. In the drain mode, an example of which is shown in the illustration of FIG. 5*b*, the hydrostatic pressure of the water and/or other fluid in the passageway 202 above the stopper 300 is greater than the hydrostatic pressure exerted on the stopper 300 by the water in which the watercraft is disposed, thus causing the stopper 300 to come unseated. When the stopper 300 unseats, the water in the passageway is able to flow through the seat past the stopper 300 and the flow plate 250, and then out of the passageway through the hull 102.

Because, in an embodiment, the stopper 300 may be buoyant in freshwater and in saltwater, the default or normal state of the stopper 300 may be the stop mode. That is, the water in which the hull 102 is disposed may exert a buoyant force on the stopper 300, causing the stopper 300 to sealingly engage the seat, and thus prevent flow into the watercraft. The stopper 300 may thus remain in the stop mode, that is, sealingly engaged with the seat, unless, or until, the pressure of the water in the inlet of the passageway 202 overcomes that buoyant force.

C. Further Example Embodiments

Following are some further example embodiments of the invention. These are presented only by way of example and are not intended to limit the scope of the invention in any way.

Embodiment 1. A watercraft comprising: a hull that defines a recessed portion, and the hull is a unified, single-piece, structure; and a self-draining scupper, comprising: a passageway that is integral with the hull and communicates with the recessed portion, the passageway extending from the recessed portion through an exterior surface of the hull; a stopper disposed in the passageway; and a flow plate that helps to confine the stopper in the passageway.

Embodiment 2. The watercraft as recited in any preceding embodiment, wherein the passageway defines a seat integral that is integral with the hull, and the stopper is configured to engage the seat.

Embodiment 3. The watercraft as recited in any preceding embodiment, wherein the flow plate is connectible to the hull in the passageway.

Embodiment 4. The watercraft as recited in any preceding embodiment, wherein the flow plate defines an opening configured to receive a portion of the stopper, and the flow plate is configured to allow passage of water through the flow plate when the opening is blocked by the stopper.

Embodiment 5. The watercraft as recited in any preceding embodiment, wherein the stopper is configured to assume a drain state in which the stopper is positioned to allow water to drain out of the passageway through the hull, and the stopper is configured to assume a stop state in which the stopper is positioned to prevent water from entering the recessed portion of the watercraft by way of the passageway.

Embodiment 6. The watercraft as recited in embodiment 5, wherein the stop state is a default state of the stopper.

Embodiment 7. The watercraft as recited in any preceding embodiment, wherein an inlet of the passageway is generally circular in shape, and/or an outlet of the passageway is generally elliptical in shape.

Embodiment 8. The watercraft as recited in any preceding embodiment, wherein both an inlet of the passageway and an outlet of the passageway have a respective tapered configuration.

Embodiment 9. The watercraft as recited in any preceding embodiment, wherein the stopper is buoyant.

Embodiment 10. The watercraft as recited in any preceding embodiment, wherein the passageway, stopper, and flow plate are all made of non-metallic materials.

Embodiment 11. The watercraft as recited in embodiment 1, wherein the watercraft comprises an integral, single piece, hollow plastic structure.

Embodiment 12. A self-draining scupper, comprising: a passageway defined by, and integral with, a plastic structure that includes a recessed portion, and the passageway is in communication with the recessed portion; a stopper disposed in the passageway; and a flow plate that helps to confine the stopper in the passageway.

Embodiment 13. The self-draining scupper as recited in embodiment 12, wherein the structure is a watercraft.

Embodiment 14. The self-draining scupper as recited in any of embodiments 12-13, wherein the passageway defines an integral seat, and the stopper is configured to engage the seat.

Embodiment 15. The self-draining scupper as recited in any of embodiments 12-14, wherein the flow plate is configured to be retained in either an inlet of the passageway or an outlet of the passageway.

Embodiment 16. The self-draining scupper as recited in any of embodiments 12-15, wherein the flow plate defines an opening configured to receive a portion of the stopper, and the flow plate is configured to enable passage of water through the flow plate when the opening is blocked by the stopper.

Embodiment 17. The self-draining scupper as recited in any of embodiments 12-16, wherein the stopper is configured to assume a drain state in which the stopper is positioned so as to allow water to drain out of the passageway, and the stopper is configured to assume a stop state in which the stopper is positioned to prevent water from entering the recessed portion by way of the passageway.

Embodiment 18. The self-draining scupper as recited in embodiment 17, wherein the stop state is a default state of the stopper.

Embodiment 19. The self-draining scupper as recited in any of embodiments 12-18, wherein the stopper is buoyant.

Embodiment 20. The self-draining scupper as recited in any of embodiments 12-19, wherein the passageway, the stopper and the flow plate are made only of non-metallic materials.

D. Further Discussion

As apparent from this disclosure, example embodiments of the invention may possess various useful and advantageous features and aspects. For example, an embodiment of the invention may not employ any kind of scupper plug or scupper insert and, as a result, the full diameter of the passageway is available to drain water from the watercraft. Thus, an embodiment of the invention may have a significantly faster drainage rate than the drainage rates that are possible with conventional scupper plugs and scupper inserts.

As another example, an embodiment of the invention comprises a self-draining scupper that may have only three parts, namely, a passageway, a stopper, and a flow plate that cooperates with a seat to confine the stopper in the passageway. The passageway may be integrally formed in a hull of a watercraft, such as by a plastic molding process for example, and thus obviates the need for a scupper insert. Some or all of the parts of example embodiments may be plastic or another material that is corrosion and rustproof. As well, embodiments of the invention may not require any maintenance, or parts replacement, in connection with normal use. Further, example embodiments may not require any sort of alignment, or other procedures, to be performed in order to ensure that the self-draining scupper will operate properly once installed.

E. Alternative Embodiments

Figure 6A:
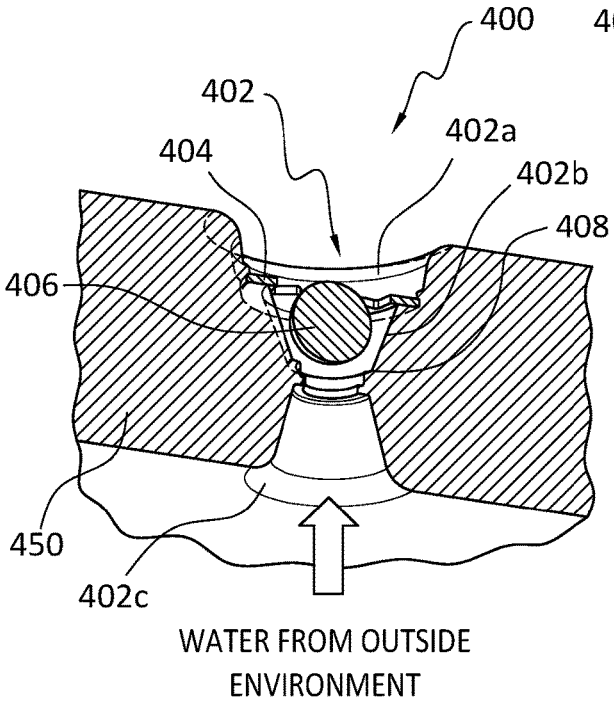
FIGS. 6*a* and 6*b* disclose an alternative embodiment to the embodiment of FIGS. 5*a* and 5*b*.
Figure 6B:
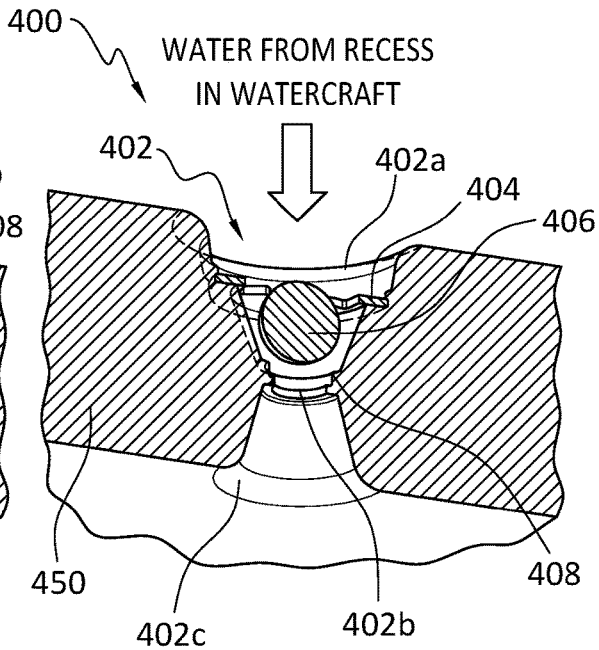

With attention now to FIGS. 6*a* and 6*b*, details are provided concerning an example alternative embodiment 400 of the invention. In general, in this alternative embodiment, a passageway 402 may be provided in which the flow plate 404 may be installed above the stopper 406, rather than below the stopper 406 as in the case of the example embodiments of FIGS. 1-5. The passageway 402 may be integrally formed with, and as part of, a hull 450. The passageway 402 may include an inlet 402*a* that is located inside a recessed portion, such as a cockpit, of the watercraft. The inlet 402*a* may communicate with a middle portion 402*b*, and water may exit the watercraft by way of an outlet 402*c* that communicates with the middle portion 402*b*.

As shown, a seat 408 defined in the passageway 402 may cooperate with the flow plate 404 to confine the stopper 406 in the passageway 402. The inside diameter of the seat 408, which may comprise a seating surface configured to engage the stopper 406, may be smaller than an outside diameter of the stopper 406.

In this embodiment, the flow plate 404 may include a central opening similar or identical to that of the flow plate 250, but side openings, such as the side openings 254 of the flow plate 250, may be omitted from the flow plate 404. That is, the flow plate 404 may have only one opening, namely, only a single central opening which may be circular in shape and which may have an inside diameter smaller than an outside diameter of the stopper 406. This construction of the flow plate 404 may enable the stopper 406 to seal against the underside of the flow plate 404 when subjected to water pressure from the environment beneath the hull, as shown in FIG. 6*a*.

The flow plate 404 may be circular, elliptical, or any other suitable shape to fit in the passageway 402. In this example embodiment, the flow plate 402 may be configured to seal against the blow molded geometry of the passageway 406 so that water cannot pass around the flow plate 402 when the stopper 404 is seated on the flow plate 402. To this end, a tack-off geometry of the passageway 402 located below the stopper 406 may have an irregular shape so as to allow water to flow around the stopper 406 to escape while still preventing the stopper 406 from fitting through (FIG. 6*b*).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A watercraft comprising:

a hull that defines a recessed portion, and the hull is a unified, single-piece, structure; and a self-draining scupper, comprising:

a passageway that is defined by the hull and communicates with the recessed portion, the passageway extending from the recessed portion through an exterior surface of the hull;

a stopper disposed in the passageway and arranged for contact with the hull; and a flow plate that helps to confine the stopper in the passageway.

2. The watercraft as recited in claim 1, wherein the hull defines a seat that is integral with the hull, and the stopper is configured to engage the seat.

3. The watercraft as recited in claim 1, wherein the flow plate is connectible to the hull in the passageway.

4. The watercraft as recited in claim 1, wherein the flow plate defines an opening configured to receive a portion of the stopper, and the flow plate is configured to allow passage of water through the flow plate when the opening is blocked by the stopper.

5. The watercraft as recited in claim 1, wherein the stopper is configured to assume a drain state in which the stopper is positioned to allow water to drain out of the passageway through the hull, and the stopper is configured to assume a stop state in which the stopper is positioned to prevent water from entering the recessed portion of the watercraft by way of the passageway.

6. The watercraft as recited in claim 5, wherein the stop state is a default state of the stopper.

7. The watercraft as recited in claim 1, wherein an inlet of the passageway is generally circular in shape, and/or an outlet of the passageway is generally elliptical in shape.

8. The watercraft as recited in claim 1, wherein both an inlet of the passageway and an outlet of the passageway have a respective tapered configuration.

9. The watercraft as recited in claim 1, wherein the stopper is buoyant.

10. The watercraft as recited in claim 1, wherein the passageway, stopper, and flow plate are all made of non-metallic materials.

11. The watercraft as recited in claim 1, wherein the watercraft comprises an integral, single piece, hollow plastic structure.

12. A self-draining scupper, comprising:

a passageway defined by, and integral with, a plastic structure that includes a recessed portion, and the passageway is in communication with the recessed portion, and the passageway comprises an inlet portion and a middle portion, the inlet portion having a larger diameter than a diameter of the middle portion;

a stopper disposed in the passageway, the stopper having an outside diameter larger than the diameter of the middle portion; and a flow plate that helps to confine the stopper in the passageway.

13. The self-draining scupper as recited in claim 12, wherein the structure is a watercraft.

14. The self-draining scupper as recited in claim 12, wherein the plastic structure defines an integral seat, and the stopper is configured to engage the seat.

15. The self-draining scupper as recited in claim 12, wherein the flow plate is configured to be retained in either an inlet of the passageway or an outlet of the passageway.

16. The self-draining scupper as recited in claim 12, wherein the flow plate defines an opening configured to receive a portion of the stopper, and the flow plate is configured to enable passage of water through the flow plate when the opening is blocked by the stopper.

17. The self-draining scupper as recited in claim 12, wherein the stopper is configured to assume a drain state in which the stopper is positioned so as to allow water to drain out of the passageway, and the stopper is configured to assume a stop state in which the stopper is positioned to prevent water from entering the recessed portion by way of the passageway.

18. The self-draining scupper as recited in claim 17, wherein the stop state is a default state of the stopper.

19. The self-draining scupper as recited in claim 12, wherein the stopper is buoyant.

20. The self-draining scupper as recited in claim 12, wherein the passageway, the stopper and the flow plate are made only of non-metallic materials.

* * * * *